United States Patent [19]

Loftus et al.

[11] 4,054,090

[45] Oct. 18, 1977

[54] ENDORSER ASSEMBLY AND DRUM THEREFOR

[75] Inventors: Peter J. Loftus, Levittown, Pa.; John A. DiBlasio, Pennsauken, N.J.

[73] Assignee: Brandt-Pra, Inc., Cornwells Heights, Pa.

[21] Appl. No.: 617,035

[22] Filed: Sept. 26, 1975

[51] Int. Cl.[2] ..... B41J 1/22

[52] U.S. Cl. ..... 101/110; 101/111; 101/376; 101/379

[58] Field of Search ..... 101/109, 110, 111, 36, 101/37, 91, 92, 375, 376, 379, 216, 219, 348–352

[56] References Cited

U.S. PATENT DOCUMENTS

| | | | |
|---|---|---|---|
| 769,296 | 9/1904 | Bender | 101/111 |
| 2,066,179 | 12/1936 | Keller | 101/111 X |
| 2,184,510 | 12/1939 | Adams | 101/379 |
| 2,631,535 | 3/1953 | Mumma | 101/376 |
| 2,691,936 | 10/1954 | Farkas et al. | 101/35 |
| 3,440,705 | 4/1969 | Johnson | 101/36 X |
| 3,518,940 | 7/1970 | Stroud et al. | 101/111 X |
| 3,665,850 | 5/1972 | Berger et al. | 101/111 X |
| 3,774,532 | 11/1973 | McKay | 101/111 |
| 3,908,543 | 9/1975 | Wirth | 101/110 |

*Primary Examiner*—Edward M. Coven
*Attorney, Agent, or Firm*—Louis Weinstein

[57] ABSTRACT

An endorser assembly comprising inking, ink transfer and endorser rolls resiliently mounted within a modular type supporting frame to enable removal and replacement of the entire endorser assembly from paper handling apparatus. The endorser and ink rolls are adapted to be easily removed from and replaced in the supporting frame. The endorser roll is adapted to print variable and semi-permanent graphic data on sheets processed by the document count handling device and may be selectively moved between an engaged and disengaged position without being removed from the proper handling apparatus. The data-bearing surfaces are resilient and raised relative to the endorser roll surface. A backing platen cooperative with the endorser roll is provided with grooves aligned with the data-bearing surfaces to prevent "back printing" of the processed sheets being endorsed. The variable and/or semi-permanent data-bearing surfaces are "crowned" in the axial direction of the endorser drum to enable wider "stripes" of graphic data to be printed on the documents being processed. "Long" lines of print may be printed on long documents by using at least one additional roller and an elongated closed loop print strip is entrained about the endorser drum and the roller. The drum may be crowned to print wider print lines while avoiding "back printing".

18 Claims, 21 Drawing Figures

Figure 5A:
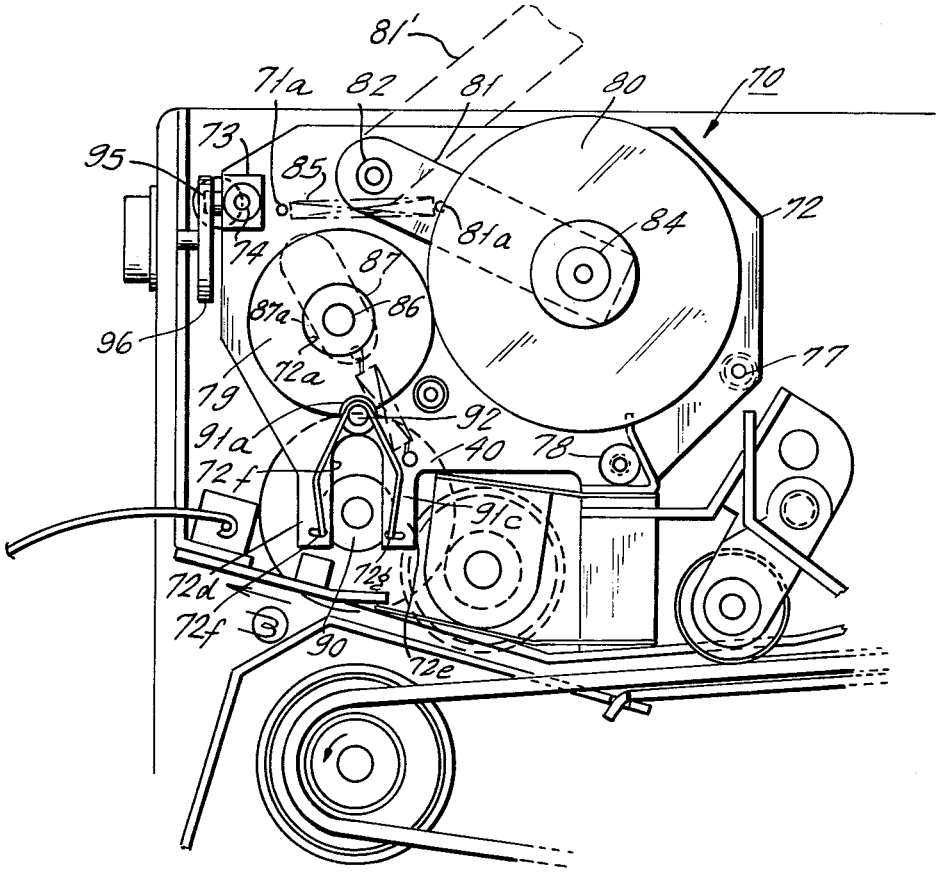

FIG. 1a
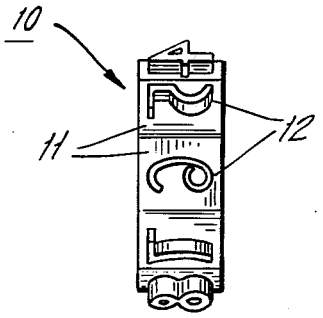
FIG. 1b
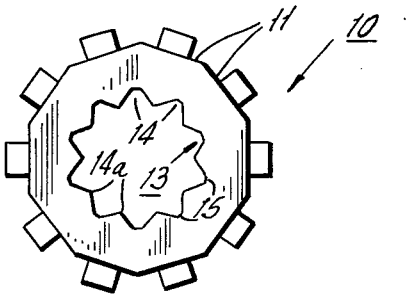
FIG. 3a
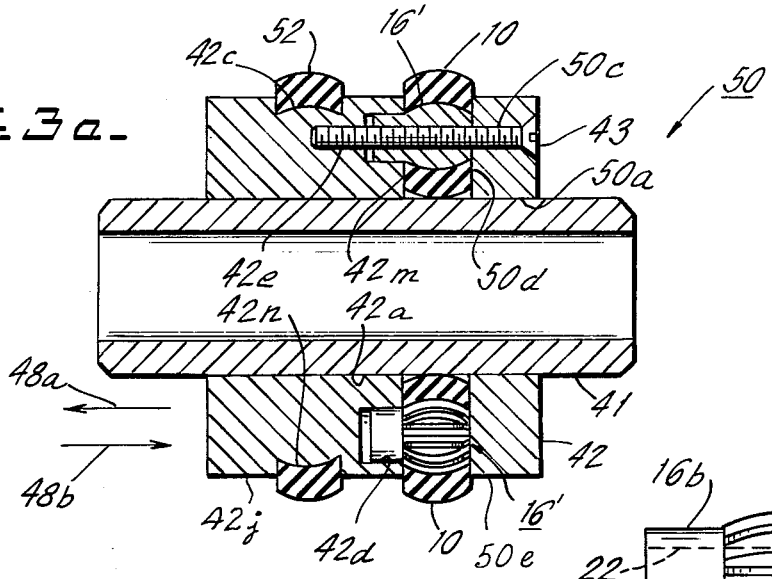
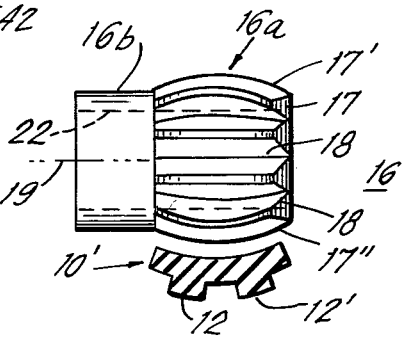
FIG. 2
FIG. 3b
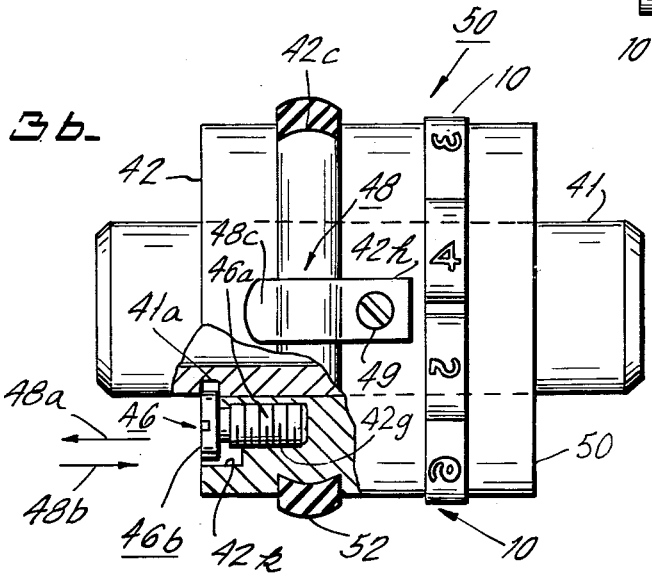

FIG. 5
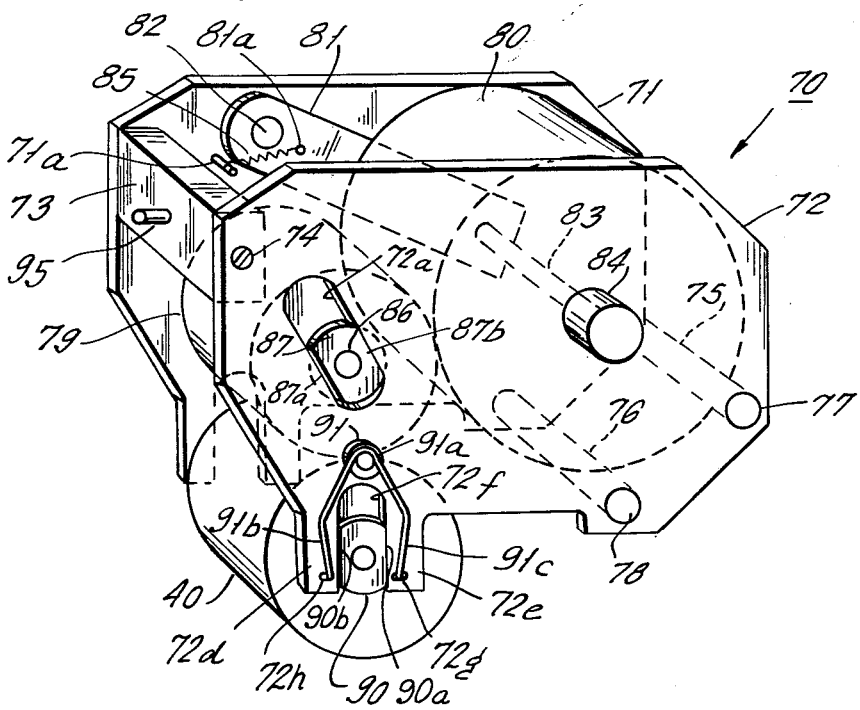
FIG. 4
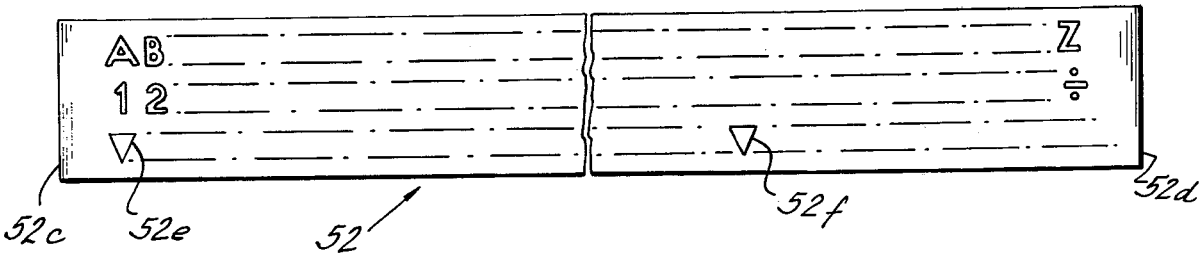
FIG. 4d
FIG. 4a FIG. 4b FIG. 4c
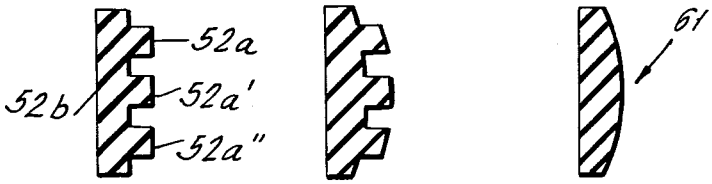
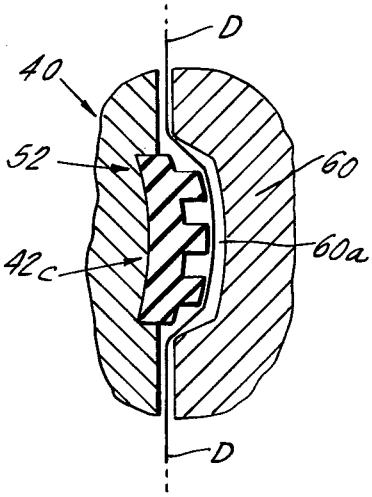

FIG. 6.
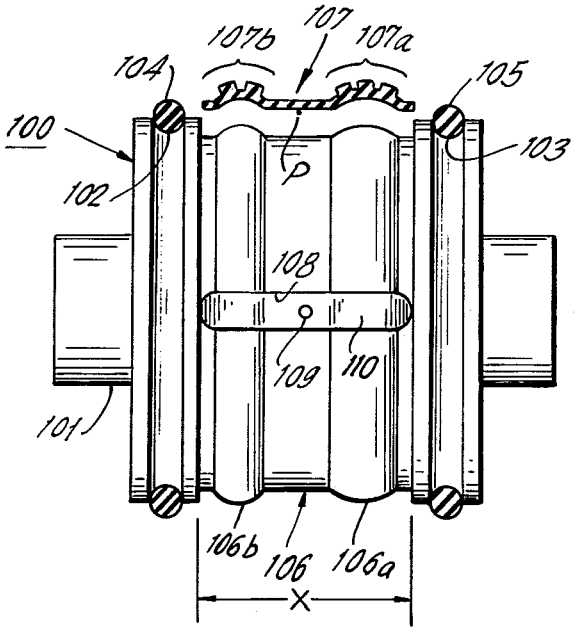
FIG. 6a.
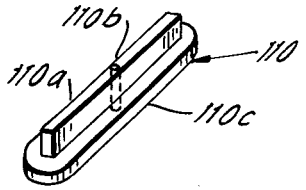
FIG. 6b.
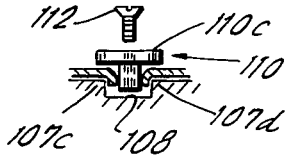
FIG. 7a.
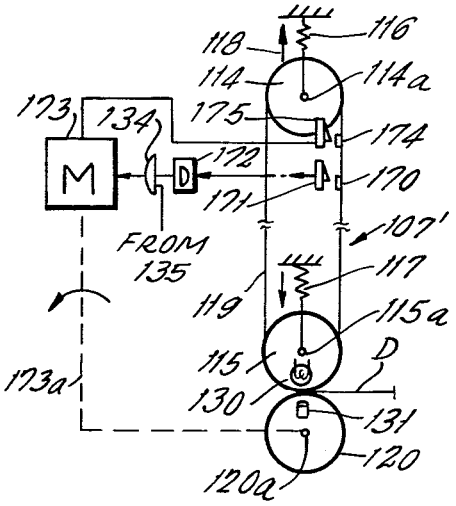
FIG. 7b.
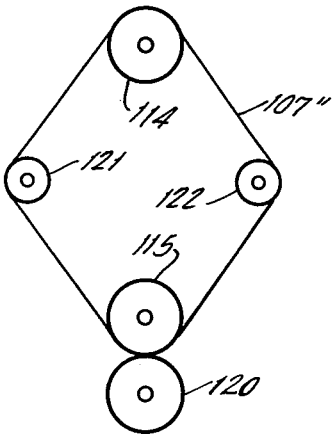
FIG. 7c.
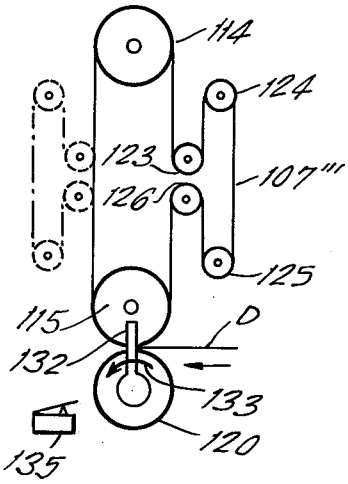
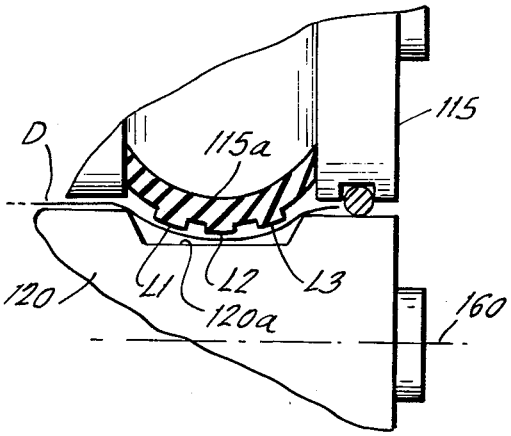
FIG. 8a.
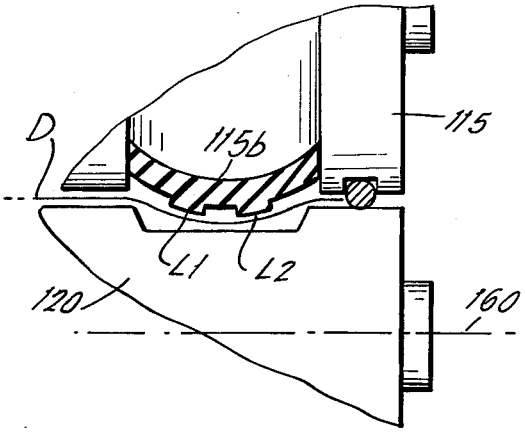
FIG. 8b.

ENDORSER ASSEMBLY AND DRUM THEREFOR

BACKGROUND OF THE INVENTION

The present invention relates to document endorsers and more particularly to endorser assemblies of modular design and endorser drums therefore which provide for printing of wide "stripes" of graphic data while preventing "back printing."

The present invention relates to printing devices and more particularly to a novel rotatable print drum for printing variable data on paper documents at a relatively high speed as the documents pass through the printing location and wherein the print drum is provided with resilient self-aligning print wheels for printing variable data, and resilient inserts for printing semi-permanent data.

A large variety of paper document handling and counting devices are presently available in the marketplace and preferably have a capability of counting and stacking paper such as tickets, food coupons, bank notes, checks, and the like. The most desirable paper handling and counting devices preferably have the capability of accurately counting documents at high operating speeds.

In addition to the requirements of counting and stacking documents at high speeds, many applications require a printing, cancelling, or endorsing capability in which fixed data is imprinted upon each paper document as it undergoes a handling and counting operation, the printing being performed by means of a rotating endorser drum having data-bearing surfaces arranged at predetermined locations around the periphery of the drum and adapted to rollingly engage an ink transfer roll and to engage the paper documents passing through the printing location and thereby transfer an ink pattern to the paper. Many such applications further require that variable data be printed on only one surface of each paper document. The printing operation must be also capable of being performed without in any way affecting (i.e., reducing) the high speed operation of the paper handling and counting machine.

For applications in which "back printing" is to be avoided, it is typical to employ a platen or backing roll having grooves aligned with the raised resilient portions of the endorser drum bearing the printed matter. The spatial relationship between the printing surfaces of the endorser and the aligned grooves is such that these confronting surfaces should not come into contact with one another at the time that the endorser drum is in the "engaged" position and when no paper is passing therebetween. Thus the portion of the document which is printed upon when passing between the platen and the endorsing drum is substantially unsupported by the platen roller. As a result, the width of the raised printing surface (measured in the axial direction of the endorser drum) containing the fixed or variable data is severely limited since, it has been found that when the raised portion containing the graphic matter to be printed is made too wide, the cooperating groove in the platen roll must be made at least as wide whereby a larger portion of the document is unsupported during printing, resulting in very poor contact between the raised printed matter and the paper document.

Also, when it is desired to print "long" lines of printed matter, the diameter of the endorser drum required makes the endorser quite impractical.

BRIEF DESCRIPTION OF THE INVENTION

The present invention is characterized by providing a novel, highly compact print drum assembly which eliminates all the disadvantages of present-day drum assemblies. The print drum assembly of the present invention utilizes resilient, annular-shaped self-aligning print wheels which cooperate with stationary mounted splined members arranged at spaced intervals around the periphery of the print drum in order to provide precise indexing of the print wheels without the need for separate independent detent mechanisms.

In one embodiment, the splines are crowned to thereby crown or curve the surfaces of the raised subject matter to be printed. The crowned or curved contour permits resilient print wheels of greater axial length to be utilized to thereby increase the amount of data which a print wheel is capable of transferring to the paper document. The grooves in the platen roll are necessarily enlarged in the axial direction to accomodate the crowned printing surface.

Semi-permanent or fixed printed matter is obtained by mounting elongated resilient strips having raised printed matter thereon within appropriate grooves provided around the peripheral surface of the endorser drum. In one preferred embodiment, the base of the groove in the drum is crowned to urge the raised printing surface of the resilient strip into a similar crowned or curved contour. This arrangement permits the use of a strip having a significantly larger dimension in the axial direction of the drum to be utilized to effectively print a larger amount of printed matter than was heretofore possible in conventional designs. The platen roll, in the case of the semi-permanent printed matter, is similarly provided with a circular groove at least as great in width, measured in the axial direction of the platen roll, as the semi-permanent printed matter portion of the strip in order to accomodate the raised printed matter and prevent "back printing" during periods in which the endorser roll is in the engaged position and paper documents are not moved between the platen and endorser drums.

As an alternative arrangement to the crowning of the abovementioned splines and endorser drum grooves, the self-aligning resilient print wheels and the resilient strips may be formed with a curvature or alternatively a curved insert may be utilized to obtain the desired crowning effect.

The endorser drum may be utilized within an endorser assembly including a swingably mounted ink roller, a resilient mounted transfer roll and a mounting for the endorser drum which permits rapid removal and replacement for the endorser drum. The assembly is mounted within a supporting framework which enables the entire endorsing assembly, including inking roll, transfer roll, and endorser drum to be removed and/or replaced as a self-contained unit. The inking roll is mounted on a swingable arm which is designed to enable removal and replacement of the inking roll without dismantling the self-contained assembly from the apparatus with which it is used.

To print "long" lines or printed matter on long documents, the endorser drum may be employed with at least one additional roller and a closed loop print strip entrained about the drum and the roller. The drum may be provided with "crowned" portions of the type described hereinabove.

BRIEF DESCRIPTION OF THE FIGURES AND OBJECTS OF THE INVENTION

It is therefore, one object of the present invention to provide a novel endorser drum assembly having self-aligning resilient print wheels whose printing surfaces are crowned, and which cooperate with co-aligned grooves in a backing or platen roll to permit an increased amount of printed matter (measured in the axial direction) to be effectively printed upon a paper document passing between the endorser and platen roll while at the same time preventing "back printing".

Another object of the present invention is to provide a novel endorser drum assembly in which fixed or semi-permanent printed matter is mounted around the periphery of the drum and is provided with a crowned printing surface which cooperates with an aligned groove in a backing roll to permit a larger amount of data to be printed upon a paper document passing between the endorsing and platen rolls while at the same time preventing the occurrence of "back printing".

Still, another object of the present invention is to provide a novel endorser assembly of self-contained design which facilitates simple and rapid removal and replacement of the inking and endorsing drums as well as simple and rapid replacement of the assembly as a self-contained unit.

Still another object of the present invention is to provide for the printing of "long" lines of print without the need for an endorser drum of a large diameter.

The above as well as other objects of the present invention will become apparent when reading the accompanying description and drawings in which:

FIG. 1*a* is a side view of a resilient print wheel design in accordance with the principles of the present invention.

FIG. 1*b* is an end view of the print wheel of FIG. 1*a*.

FIG. 2 shows a side view of a splined pin adapted for indexably mounting a print wheel of the type shown in FIGS. 1*a* and 1*b*.

FIG. 3*b* is a partially sectionalized view of one preferred embodiment of an endorser drum designed in accordance with the principles of the present invention.

FIG. 3*a* shows a sectional view of the drum assembly of FIG. 3*a*.

FIG. 4 is a top plan view of a resilient endorser insert which may be utilized with the endorser drum assembly of FIGS. 3 and 3*a*.

FIG. 4*a* is a view of the strip of FIG. 4.

FIG. 4*b* shows a sectionalized view of an alternative embodiment of the print strip of FIG. 4, and FIG. 4*c* shows a sectionalized view of an insert which may be used with the endorser strip of FIG. 4*a*.

FIG. 4*d* shows a detailed view of a portion of an endorser drum and a platen roll useful in describing the advantages of the present invention.

FIG. 5 shows a perspective view of an endorser assembly embodying the principles of the present invention.

Figure 5B:
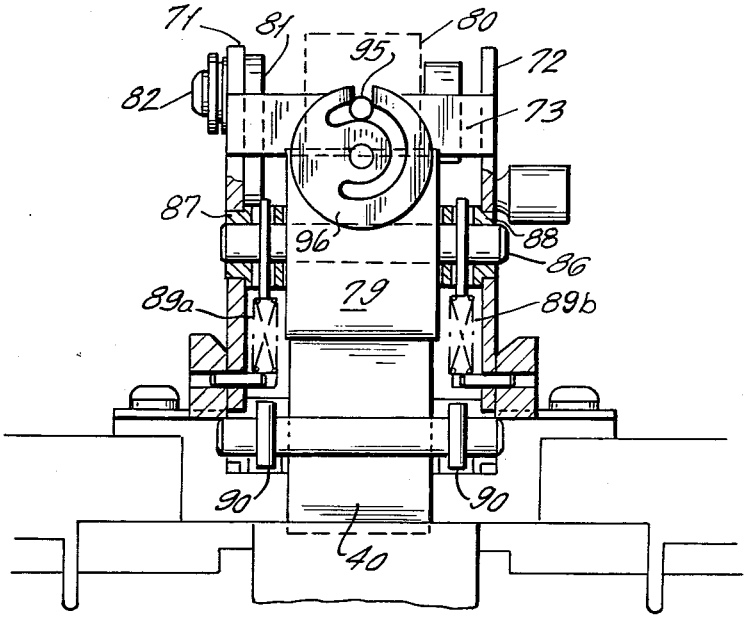

FIGS. 5*a* and 5*b* show elevational and end views of the endorser assembly of FIG. 5.

FIG. 6 shows a side view of an alternative embodiment of the present invention.

FIG. 6*a* is a perspective view of a keeper member utiliz;ed with the embodiment of the FIG. 6.

FIG. 6*b* shows a detailed view of the manner in which the keeper member of FIG. 6*a* cooperates with the endorser drum and print strip of FIG. 6.

FIGS. 7*a*–7*c* show elevational views of another alternative embodiment of the present invention.

FIGS. 8*a* and 8*b* show detailed views of the type shown in FIG. 4*d* and which are useful in describing another feature of the present invention.

A DETAILED DESCRIPTION OF THE INVENTION

FIGS. 1*a* and 1*b* show a print wheel substantially identical to that described in co-pending application Ser. No. 546,621 and which cooperates with the splined portion of pin 16 shown in FIG. 2. The resilient print wheel 10 is formed of a resilent material such as, for example, rubber, or a suitable resilient plastic. The elasticity of the material enables the print member to be selectively deformed and/or stretched during use, which properties are utilized in conjunction with the precise self-aligning capability as well as being utilized to obtain the crowning effect as will be more fully described hereinbelow.

The exterior surface of print wheel 10 is provided with a plurality of substantially flat faces 11 each having an integrally formed raised character or symbol 12 (or other graphic subject matter) extending upwardly from each flat face 11. Alternatively, each face 11 may be provided with more than one character arranged axially and/or transverse to the axial direction and, due to the crowning effect, yields a print wheel which may be substantially longer in the axial direction than conventional print wheels (or the print wheels of application Ser. No. 546,621) thus enabling the print wheel to accommodate characters, symbols, or other graphic matter equivalent to two or three lines of characters arranged transverse to the axial direction. Alternatively each face 11 may be provided in with a significantly taller character than was heretofore possible, due to the crowning effect.

The interior surface 13 of the print wheel is provided with a substantially star-like configuration collectively formed by a plurality of V-shaped grooves 14, each of which is truncated at their base portions to form flat base portions 15. Adjacent V-shaped grooves cooperatively form V-shaped projections 14*a* directed radially inward.

Each resilient print wheel is mounted upon a pin 16 which has a splined portion 16*a* as shown best in FIG. 2 and which has an exterior surface of a substantially star-like configuration. The splined portion 16*a* has a star-like cross-sectional periphery substantially similar to the star-like interior surface 13 of the print wheel. The star-like configuration is made up of a plurality of outwardly directed substantially V-shaped projections 17 with each pair of adjacent projections collectively defining an inwardly directed V-shaped groove 18. Each of the V-shaped grooves 18 and V-shaped projections 17 are crowned or curved in the axial direction of pin 16 as shown by the contour of V-shaped projections 17' and 17''. The remaining portion 16*b* of the pin 16 may be substantially smooth and of a cylindrical configuration. Due to the crowning effect, the resilient print wheel 10, when mounted upon splined portion 16*a*, assumes a similarly crowned contour as shown at 10' of the resilient print wheel shown in FIG. 2 and is further shown as having two raised portions 12 and 12' which may constitute two rows of characters or other printed matter. Due to the crowning effect, as many as three of four rows of raised characters, symbols, or other graphic matter may be provided and the number of rows of raised characters shown in FIG. 2 should not be considered as in any way limiting the invention.

The partially splined pins are mounted within suitable openings provided in an endorser drum assembly shown best in FIGS. 3*a* and 3*b*.

The self-aligning feature of the cooperating splined portions of pins 16 and the resilient print wheel 10 is set forth in detail in the abovementioned application Ser. No. 546,621 and hence a detailed description of the self-aligning feature will be omitted herein for purposes of simplicity. It is sufficient however, to understand that the cooperating projections and grooves provided around the periphery of the splined portion 16*a* of pin 16 and the similar projections and grooves provided about the interior surface of the resilient print wheel 10 permit the print wheel to be indexed about the splined portion 16*a* of pin 16 (which is maintained stationary as will be more fully described hereinbelow) to enable that face having the desired data to be printed upon a document to be moved into the print position. The resilient print wheel stretches during indexing until its projections 14*a* ride over the projections 17 of the splined portion whereupon the resilient wheel contracts and the projections 14*a* of the resilient wheel "snap" into the grooves 18 of the splined portion 16*a*, which "snapping" can be felt by the operator when moving the resilient print wheel to further assure precise indexing alignment to move the appropriate face 11 and its raised printed matter into the printing position.

The splined pins carrying the resilient self-aligning print wheels are mounted within an endorser drum assembly 50 as shown in FIGS. 3 and 3*a*. The splined pins 16 and self-aligning indexable print wheels do not rotate relative to one another during a printing operation, but together revolve about the central axis of the print drum assembly 40. Endorser drum assembly 40 is adapted to mount a plurality of self-aligning print wheel assemblies and/or print strips 52. The drum assembly comprises a first drum body 42 of substantially circular shape which is provided with a central opening 42*a* for receiving hollow cylindrical member 41 which is adapted to have its opposite ends fitted within a pair of bearings as will be more fully described. The drum body 42 is further provided with a continuous recess 42*c* surrounding the surface of drum 42 and adapted to receive a resilient insert strip 52 to be more fully described, which strip is utilized to print fixed or semi-permanent data upon the paper documents. The recess 42*c* is provided with a crowned base portion 42*n* hich urges the outer print surface of the resilient strip 52 into a similarly crowned contour. The right-hand end of drum body 42, as shown in FIG. 3*a*, is provided with a plurality of cylindrically-shaped axially aligned recesses 42*d* each of which is adapted to receive the smooth cylindrical ends 16*b* of a pin 16. Two of these recesses are provided with tapped apertures 42*e* (only one of which is shown for purposes of simplicity) for receiving threaded fasteners such as, for example, the threaded fastener 43 to secure the second drum body 50 to the first drum body 42.

As was described earlier, a resilient print wheel is fitted upon each splined portion as shown best in FIG. 3*a*. Two of the pins are provided with axial openings which serve as clearance openings for the threaded fasteners 43. FIG. 3*a* shows one of the clearance openings as being provided in the pin 16'.

The drum body 42 is further provided with recess 42*k*. A tapped aperture 42*g* extends downwardly from the base portion of recess 42*k* and is adapted to receive threaded fastener 46 whose threaded portion 46*a* threadedly engages tapped aperature 42*g*. A marginal portion of the periphery of head 46*b* of threaded fastener 46 is slideably fitted into a groove 41*a* provided in hollow tubular member 41 and, by rotation of threaded fastener 46, the first print body 42 is adapted to be longitudinally moved in either the left or right-hand direction, shown respectively by arrows 48*a* and 48*b*, relative to hollow tubular member 41 in order to accurately adjust the axial positioning of the printing surfaces relative to the platen roller, as will be more fully described hereinbelow.

Drum 42 is further provided with an elongated axially aligned recess 42*h* for receiving substantially Z-shaped claming member 48 secured to first drum body 42 by threaded fastener 49 which threadedly engages a tapped aperature in the drum body 42. The free end 48*c* of releasable clamping member 48 overlies at least a portion of recess 42*c* so as to clamp the free ends of the resilient insert strip carrying the fixed or semi-permanent data as will be more fully described.

The endorser drum assembly 40 is further comprised of a second drum body 50 having a central opening 50*a* for receiving hollow tubular member 41. The right-hand end of drum member 50 (see FIG. 3*a*) is further provided with a pair of clearance openings 50*c*, one of these openings being shown in FIG. 3*a*, for receiving a threaded fastener 43 which serves to secure drum body 50 to drum body 42 and which further serves to prevent any axial movement of resilient print wheels 10 since they are sandwiched between the right-hand end surface 42*m* of drum body 50. The pins 16 serve as spacing means for providing the appropriate spacing between the adjacent end surfaces 42*m* and 50*d* of the drum bodies 42 and 50, respectively.

The resilient indexable self-aligning print wheels are adapted to revolve about the axis of rotation of the endorser drum 40 and a portion of each of the peripheries of the resilient print wheels extends beyond the outer periphery of the first and second drum bodies 42 and 50 in order to rollingly engage an ink transfer roller and a paper document, as will be more fully described in connection with FIG. 5. The raised portions of the print strips and the resilient print wheels, being raised above the surface of the drums 42 and 50, prevent the peripheral surfaces 42*j* and 50*e* of the endorser drums 42 and 50 from engaging the ink transfer roll.

FIG. 4 shows a top plan view of an elongated insert strip adapted to be positioned within recess 42*c* of first drum body 42. Strip 52 is preferably formed of a resilient material such as, for example, rubber or vinyl, and has a durometer selected to enable the raised characters, symbols, or other graphic material formed along the print surface of the strip to undergo compression as they rollingly engage and hence imprint a paper document.

FIG. 4*a* shows an end view of the strip having three raised indicia 52*a*, 52*a*' and 52*a*'' provided on the print surface of strip 52. The back surface is preferably reinforced with a cloth backing 52*b* to limit the amount of elongation or stretching which the strip may undergo. The strip is mounted to first drum body 42 by loosening threaded member 49, positioning one end, for example, end 52*c* of strip 52 beneath a portion of the clamping member 48, pressing the strip into groove 42*c* and then inserting the opposite end 52*d* of the strip beneath clamping member 48, after which threaded member 49 is tightened to firmly clamp the insert strip 52 into position.

The insert strip may be provided with raised index markers, such as the markers 52*e* and 52*f*, which cooperate with the variable data printed on documents by the resilient wheels 10 to positively indicate the starting point of the variable data. This is extremely helpful in applications wherein variable data may be printed more than once upon the surface of a paper document, or when the beginning of a line of print is not necessarily in registration with one edge of the document.

As shown best in FIG. 4*a*, the print strip may have 3 lines of printed material in the axial direction relative to the endorser drum assembly 40 of FIG. 3. It should be understood that, the print surface of the print strip will assume a similar crowned contour the effect of which, and the advantage of which will be more fully described hereinbelow.

FIG. 4*d* shows an enlarged view of a portion of the endorser drum 40 showing the recess 42*c* having a print strip 52 mounted therein. A rotatably driven backing or platen roll 60 cooperates with endorser drum 40 and is provided with a circular recess 60*a* whose width, measured in the axial direction of the platen roll, is at least as great as the width of the insert strip 52. During printing the backing roll 60 and endorser drum assemblies rotate about their respective axes of rotation. When a paper document D passes therebetween, it assumes the contour as shown in FIG. 4*d* due to the cooperating nature of the raised portion of print strip 52 and groove 60*a* provided in the platen roll 60. The paper document assumes a curved contour in the region of groove 60*a*. Due to the curvature of the print surface of the print strip 52 the ink bearing print surfaces make good engagement with the confronting surface of the paper document D so as to positively and effectively transfer the ink on the print surfaces to the confronting surface of the paper document.

In the event that no paper document is fed between the platen roll 60 and the endorser drum 40 at the time when the endorser drum is in the engaged or operative position and fresh ink is carried on the print surfaces of the print strip, due to the geometry and spatial relationship between the endorser drum 40 and the groove 60*a* in the platen roll 60, no ink will be transferred to the base of groove 60*a* so as to prevent the transfer of ink thereto and hence the subsequent transfer of ink onto the back of a paper document, thereby avoiding any "back printing".

The platen roll 60 is preferably formed of a resilient material and in one embodiment the surface portions of the platen roll on opposite sides of the groove 60*a* may make rolling engagement with the endorser drum surfaces on opposite sides of the insert strip 52 to provide good rolling engagement therebetween. For example, this rolling engagement may be utilized to provide rotational drive to the freewheelingly mounted endorser drum by means of positively driving the platen roll and by virtue of the rolling engagement between drum 40 and roll 60, frictional drive is imparted to the endorser drum 40. As an alternative arrangement, the opposite ends of the drum assembly 40 may be provided with resilient O-rings adapted to frictionally engage confronting surfaces of the platen roll to enable the rotating roll to drive the endorser drum. Of course, the endorser drum, if desired, may be positively driven and frictionally engage the platen roll to drive it.

It should be understood that the self-aligning print wheels operate in substantially the same manner as the print strip 52 shown in FIG. 4*d* wherein the curved or crowned splined portion 16*a* of pins 16 urge the resilient print members into a similar crowned contour and wherein such resilient members are coaligned with a cooperating groove in the platen roll to perform printing in a similar fashion.

As an alternative to the arrangement of FIG. 3*a* wherein the base 42*n* of groove 42*c* is crowned, the base of groove 42*c* may be made flat and the insert strip may be molded with a crowned contour in the manner shown in FIG. 4*b* to impart the desired curvature to the print surface thereof.

As another alternative, the groove 42*c* may have a flat base and a separate additional insert strip 61 may be inserted between the flat base of groove 42*c* and the backing 52*b* of the resilient insert strip to assume a crowned contour. In this case the added strip 61 may be mounted either permanently into recess 42*c* or may be removably inserted when a new insert strip 52 is mounted to drum 40.

FIG. 6 shows another preferred embodiment of the present invention, which is comprised of a substantially cylindrical one-piece drum member 100, having a hollow cylindrical member 101 inserted within an axially aligned opening provided therein for the purpose of mounting the drum to a bearing assembly, for example, of the type described hereinbelow in connection with FIGS. 5–5*b*. The periphery of the drum is provided at opposite ends thereof with substantially semi-circular-shaped grooves 102 and 103 for receiving closed-loop resilient O-rings 104 and 105 whose sectional views are shown in FIG. 6. These O-rings are adapted to make rolling engagement with a cooperating backing or platen roll as was described hereinabove in connection with FIG. 4*d*, one suitable platen roller also being described in connection with FIG. 5*a* hereinbelow. The O-rings further serve to provide appropriate spacing between the endorser roll and the platen roll.

The peripheral portion of the drum 100 extending between the O-ring grooves 102 and 103 is provided with a recess 106 running substantially the entire axial length of the drum (with the exception of the end portions of drum 100 receiving the O-rings 104 and 105) for the purpose of receiving a resilient strip 107 (shown only in sectional view in FIG. 6) whose width is substantially equal to the axial length of recess 106.

Recess 106 can be seen to be provided with crowned portions 106*a* and 106*b* arranged at spaced intervals along the recess 106. These crowned portions function in the same manner as was described hereinabove in connection with the crowned base portion of recess 42*c* shown, for example, in FIG. 3*b*. The crowned portions 106*a* and 106*b* are cooperatively aligned with the print bearing portions 107*a* and 107*b* respectively of the print strip 107 so as to urge the print strip into a similar crowned contour when the strip is positioned firmly against the surface of the drum 100 and within recess 106.

Axially aligned within recess 106 is an elongated narrow slot-like recess 108 provided with a tapped aperture 109. Recess 108 is adapted to receive keeper member 110 shown best in FIGS. 6*a* and 6*b*. The keeper member 110 is an elongated member having an elongated projection 110*a* provided along its bottom surface, which projection is adapted to fit into recess 108. The keeper member 110 is provided with a clearance opening 110*b* for receiving threaded fastening member 112 shown in FIG. 6*b*.

The manner in which the print strip is mounted upon drum 100 is as follows:

The print strip 107 is a substantially flat strip similar to that shown in FIG. 4 except that its width is selected so as to be substantially equal to the axial length of recess 106. One edge (for example, the left-hand edge of the print strip 52 shown in FIG. 4) is positioned immediately adjacent and preferably slightly overhanging one edge of recess 108. The strip is then wrapped around drum 100 until its opposite edge now rests above the opposite edge of recess 108, whereupon the projection 110*a* of keeper member 110 is then pressed downwardly and into recess 108 so as to at least partially draw the edges 107*c* and 107*d* into recess 108 causing the edges of strip 107 to be sandwiched between the sidewalls of recess 108 and the main body portion 110*c* of keeper member 110. When the keeper member 110 is properly mounted within recess 108, its clearance opening 110*b* is co-aligned with tapped opening 109*a*. Threaded fastening member 112 is then inserted within clearance opening 110*b* and threadedly engages tapped aperture 109*a* to firmly secure print strip 107 to drum 100.

The crowned portions of recess 106 may be fewer in number or greater in number than those shown in FIG. 6 and may have a length greater or less than that shown in FIG. 6 (measured in the axial direction of drum 100) so as to be aligned with the raised print portions of an associated print strip. FIG. 6 constitutes a simplified version of an endorser drum wherein even though more than one raised print portion is provided within the endorser assembly, all of the raised print portions are integrated into a single wide strip thereby greatly simplifying both installation and removal thereof. It should be obvious, however, that the single print strip 107 of FIG. 6 could, for example, be two separate print strip portions severed from one another along an imaginary line represented by the point P as shown in FIG. 6, which line for the severed portion is positioned intermediate the raised print portions 107*a* and 107*b*. The advantage of such an arrangement would be to permit the changing of one raised print portion independently of the other.

FIGS. 7*a* through 7*c* show still another preferred embodiment of the present invention wherein the print strip may be significantlly greater in length than the print strip of FIG. 4, for example. Considering the length of the print strip as the dimension between the left and right-hand edges 52*c* and 52*d*, in the embodiments described hereinabove, this length is dependent upon the circumference and hence diameter of the drum upon which the print strip is mounted. In order to be able to provide print strips of significantly greater length and avoid the need for providing drums of significantly increased diameter and hence circumference to mount such print strips, any of the arrangements of FIGS. 7*a* through 7*c* may be employed.

As shown in FIG. 7*a*, a closed loop print strip 107' having raised portions, for example, as shown in FIG. 6 and which contains printed matter, is entrained about a pair of drums 114 and 115 which are adapted to rotate about shafts 114*a* and 115*a* respectively. The print strip 107' is maintained substantially taut by the resilient biasing means 116 and 117 which are mounted between suitable frame members and the shafts 114*a* and 115*a* whereby resilient bias means 116 operates as a tension spring urging shaft 114*a* and hence drum 114 upwardly in the direction shown by arrow 118. Spring means 117 may be of the compression type, and be mounted between a support frame and shaft 115*a* so as to urge drum 115 in the direction shown by arrow 119. The drum 115 is adapted to be urged toward a backing or platen roller 120 which is designed with cooperating grooves opposing the raised print portions of the print strip, the grooves being of the type shown by groove 60*a* of FIG. 4*d*. Either one or both of the drums 114 and 115 may be provided with crowned portions behind each raised print portion of the print strip 107'. The advantage of the arrangement shown in FIG. 7*a* resides in the fact that elongated lines of printed matter may be printed upon elongated documents without the necessity for providing print drums of unduly large diameters. For example, if it is desired to print elongated lines of printed matter on a lengthy document such as, for example, a document of legal-sized dimensions (i.e., 8 inches by 13 inches), two rollers of substantially small diameter may be used in the arrangement of FIG. 7*a* as a substitute for one large diameter drum. For example, assuming that an elongated line of printed matter is to be printed so that the length of the line of printed matter is of the order of 11 inches, the diameter of a drum for mounting such a large print strip would be of the order of more than 3.5 inches. Using the arrangement of FIG. 7*a*, and spacing the smaller diameter drums 114 and 115 by an appropriate distance, the diameters of these drums may be significantly reduced.

FIG. 7*b* shows another arrangement where additional tension maintaining drums or rolls 121 and 122 are provided for receiving a closed loop print strip 107'' of increased total length as compared with the embodiment of FIG. 7*a*. The drums 121 and 122 may be spring-loaded in the same manner as the drums 114 and 115 of FIG. 7*a* to maintain the print strip 107' under appropriate tension.

FIG. 7*c* shows still another arrangement wherein tension maintaining drums 123 through 126 are utilized and are arranged along the right-hand run of the elongated closed loop print strip 107''' to further increase the overall length of the print strip. One or more of the drums 123 through 126 may be spring-loaded in the manner set forth with regard to drums 114 and 115 of FIG. 7*a*. Additionally, drums substantially identical to the drums 123 through 126 may be provided along the left-hand run of print strip 107''' extending between drums 114 and 115 to still further increase the total overall length of the elongated closed loop print strip while at the same time avoiding the need for a single print strip mounting drum having a large and hence impractical diameter. It should be understood that the drums may be of the same or of differing diameters if desired. Also, the drum 115 may include the self-aligning print wheel assembly.

Although FIGS. 7*a* through 7*c* show the platen, or backing roller, as cooperating with roller 115 to perform the printing operation, it should be understood that the platen roller may cooperate with any of the other rollers, if desired.

Although it is preferred to provide the crowned portion as an integral part of at least the drum 115, any of the alternative arrangements described in connection with FIGS. 4*b* and 4*c* may be substituted therefore so long as appropriate curvature of the print surface of the raised print portions is obtained.

FIGS. 8*a* and 8*b* show the manner in which the radius of curvature of the crowned portions may be utilized to control the number of lines printed (i.e., the axial extent of the print surface). FIGS. 8*a* and 8*b* each show portions of a platen or backing roller 120 having grooves or recesses 120*a* which are equal in width (measured in the direction of the longitudinal axis 160 of the platen roller).

FIGS. 8*a* and 8*b* show a portion of a drum 115 in which the crown 115*a* of FIG. 8*a* has a larger radius of curvature than the crown 115*b* provided in the drum of FIG. 8*b*. The radius of curvature of the crowned portion 115*a* is adapted to permit printing of 3 lines (L1, L2, and L3) of characters whereas the increased radius of curvature of the crowned portion 115*b* in FIG. 8*b* is adapted to permit only two lines (L1 and L2) of printed characters to be imprinted upon the document D. Thus for a platen roll having a recess of a given width and depth, it is possible to interchange endorser or print rolls whose crowned print surface portions have different radii of curvature to increase or decrease the effective printing area in the axial direction.

In applications where it is desired to print elongated lines of characters or graphic data, in order to be assured that the start of such line is in registry with the starting edge of a paper document, the document may be brought to the nip formed between the platen roll 120 and the print roll 115 (FIG. 7*a*). A gate 132 (see FIG. 7*c*) prevents further movement of the document. The light source 130 and light sensing device 131 detect the presence of the leading edge of document D which prevents the light emitted by source 130 from being detected by sensor 131, thus causing gate 132 to swing in direction 133 and unblock document D. The gate 132 and light source-detector assembly 130–131 have been shown in different Figures for purposes of simplicity, it being understood that these elements are all utilized in the same apparatus. At a time when the platen roll 120 is at a standstill, a marker or projection 170, provided along the interior surface of the print strip 107' or extending outwardly from one edge thereof, activates a microswitch 171. Upon activation, a pulse is transmitted to a delay circuit 172 which, after a predetermined delay applies a signal to logic gate 134. When gate 132 has swung out of the path of movement of document D, microswitch 135 generates a signal which is applied to logic gate 134. Thus when the gate 132 has activated microswitch 135 and the time delay interval has elapsed, logic gate 134 energizes motor M. When the trailing edge of the document passes beyond the nip, the light sensor is activated to return gate 132 to the blocking position thereby deactivating motor M, and energizing motor 173 which is mechanically linked to the platen roller shaft 120*a* as represented by dotted line 173*a*, so as to rotate platen roller 120 and thereby drive document D between the platen roll and the print drum 115. A second projection 173 may also be provided along the interior surface of the strip or extending outwardly from one edge thereof and laterally displaced from projection 170 so as to activate a second microswitch 175 to de-energize motor M. As an alternative to the marker and cooperating microswitch as shown in FIG. 7*a*, the print strip may be provided with an opening and a light source positioned to one side of the opening and a photodetector (replacing the microswitch) placed upon the opposite side of the opening to function in substantially the same manner as the microswitch 171 described hereinabove in order to be assured that each document is in registry with the beginning of the line (or lines) of print to be transferred to the documents. Obviously, the marker is displaced from the beginning of a line of print on strip 107' so that the beginning of a line of print will be at the nip between drum 115 and platen roller 120 when the marker is positioned adjacent its associated microswitch (or photocells).

FIGS. 5, 5*a* and 5*b* show an endorser drum assembly 70 which may utilize the endorser drum of FIG. 3.

The endorser assembly 70, which is adapted to be removable and/or replaceable as a completely self-contained assembly, includes a pair of plates 71 and 72 maintained in spaced parallel fashion by a cross-piece 73 secured to plates 71 and 72 by suitable fastening means such as, for example, the fastening means 74. Additional spacer rods 75 and 76 are arranged between plates 71 and 72 and secured thereto, for example, by the fastening means 77 and 78 to serve as further spacing means.

The endorser assembly is further comprised of the endorser or printing roll 40, an ink transfer roll 79 and an inking roller 80. Inking roller 80 is mounted upon the free end of rod 81 which is pivotally mounted to plate 71 by a pivot pin 82. The free end of arm 81 free-wheelingly supports inking roller 80 by means of a shaft 83 and a split-ring locking mechanism 84 which assembly is shown in detail in FIGS. 12*a*–12*e* of copending application Ser. No. 465,700 filed Apr. 30, 1974 and assigned to the assignee of the present invention. The description therein has been omitted herein for purposes of simplicity.

Inking roller 80 is maintained in engagement with transfer roll 79 by means of overcenter spring 85 having a first end coupled to arm 81 by pin 81*a* and having a second end coupled to plate 71 by pin 71*a*. The inking roll arm 81 may be moved to the dotted line position 81' shown in FIG. 5*a* against the biasing force of spring 85 in order to facilitate removal and/or replacement of the inking roll. The inking roll arm is retained on the dotted line position by overcenter spring 85 until maintenance is completed, at which time the inking roll arm may than be lowered to the solid line position shown, for example, in FIG. 5 where the overcenter spring arrangement again biases the inking roll into rolling engagement with transfer roll 79.

Transfer roll 79 is mounted upon a shaft 86 which is provided at each of its ends with a pair of bearings 87 and 88 each being mounted within an associated elongated slot such as, for example, the elongated slot 72*a* provided in plate 72, which receives bearing 87. A similar slot is provided in plate 71 for receiving bearing 88 and is aligned within diagonally aligned slot 72*a*. The bearings 87 and 88 are each provided with a pair of truncated surfaces 87*a* and 87*b* which are slidably received within the slot provided in plate 71.

A pair of springs 89 and 89*a* (see FIG. 5*b*) are secured between the undersides of each of the bearings and between pins 71*b* and 72*b* secured to plates 71 and 72 so as to urge transfer roll 79 substantially in the diagonally downward direction and into rolling engagement with endorser roll 40. The print wheels and print strips are sufficiently resilient to assure satisfactory transfer of ink to all of the crowned printing surfaces. Plates 71 and 72 are each provided with a pair of downwardly extending projections, the detailed arrangement for plates 72, for example, being shown best in FIGS. 5 and 5*a* wherein the downwardly extending projections 72*d* and 72*e* of plate 72 define the opposite parallel sides of an elongated slot 72*f* for receiving one bearing 90 of the endorser roll assembly 40. As shown in FIG. 3*a*, hollow cylindrical member 41 has mounted thereto the bearings 90 and 91 (see FIG. 5*b*). Bearing 90, for example, is provided with a pair of truncated surfaces 90*a* and 90*b* which are slidably mounted between the parallel sidewalls of slot 72*f*. A substantially U-shaped spring 91 has its yoke portion 91*a* secured to plate 72 by fastening member 92 and has a pair of downwardly depending arms 91*b* and 91*c* whose bottom-most ends are bent inwardly to extend into a pair of slots 72*h* and 72*g* respectively, provided near the bottom ends of projections 72*d* and 72*e*. The bent ends of the spring arms extend inwardly through these slots and are adapted to bear against the cylindrical periphery of bearing 90 to retain the endorser roll in position and to urge the bearing and hence the endorser upwardly towards transfer roller 79. It should be understood that substantially the identical arrangement is provided on plate 71.

To remove the endorser roll, the endorser assembly is lifted out of the apparatus cooperating therewith and the endorser roll is simply pulled away from the supporting plates 71 and 72 against the inwardly directed biasing forces of the inwardly bent ends of the spring arms so as to move these free ends away from their associated bearings and thereby remove the bearings from their associated slots. The endorser roll may be replaced in a similar fashion simply by aligning the truncated surfaces of the bearings with their associated slots, pressing the endorser into the slots to cause the inwardly bent free ends to pass around the diameter of the cylindrical portions of the bearings, after which they then move inwardly toward one another to grip the bearings and retain the bearings and hence the endorser roll in position. The gripping forces exerted by the spring members upon the bearings of the endorser need not be too great, since the endorser roll is normally adapted to bear against the platen roller when in the engaged position. Thus, the platen roller exerts an upwardly directed force against the endorser roller which has a downwardly directed force imparted thereto by the springs which resiliently urge the ink transfer roll 79 generally downwardly and against the endorser roll 40 to maintain the ink transfer roll and the platen roll in rolling engagement with the endorser roll.

A pin 95 is provided intermediate the ends of the bracing cross-piece 72 and projects outwardly therefrom. Pin 95 is adapted to cooperate with a spiral-shaped slot 96*a* in member 96 which cooperates with a manually operable locking member designed to rotate so as to move the endorser assembly upward by an amount sufficient to displace the endorser roll from the platen roll and prevent printing and which may be rotated in the reverse direction to move the endorser assembly downwardly by a distance sufficient to provide firm rolling engagement between the endorser roll and platen roll. This spiral-shaped member 96, shown in FIGS. 5, 5*a*, and 5*b* is described in detail in copending application Ser. No. 618,280 filed Sept. 30, 1975 and assigned to the assignee of the present invention and a detailed description has been omitted for purposes of simplicity. It should be understood that any other type of member may be utilized to move the endorser assembly into either the engaged or the disengaged position to respectively select or deselect the printing operation. Thus, when no printing is desired, it is now possible to simply displace the endorser assembly from the platen roller forming a part of the apparatus in which the endorser assembly is employed. In cases where it is desired to replace the inking roll due to exhaustion of the supply of ink, the arm upon which the inking roll is free-wheelingly mounted may be lifted in the manner set forth hereinabove to remove the exhausted inking roll and substitute a fresh one therefore, which operation can be performed without removing the endorser assembly from the equipment in which it is used. This can very clearly be seen from FIG. 2*a*, for example, of copending application Ser. No. 618,280 referred to hereinabove.

If it is desired to remove the endorser roll in order to change the variable data or the semi-permanent strips, the assembly 70 of FIG. 5 may be lifted out as a self-contained unit, the endorser roll may be simply and easily removed from its mounting, adjusted, and simply pressed back into position. The design simplicity of the self-contained unit 70 makes it applicable for use within a wide variety of equipment to obtain the benefit of the advantage of the self-contained assembly, as well as the advantages of the novel insert strips and self-indexing print wheels which, as have been described hereinabove, have a crowned contour to permit the width of the insert strips and/or the print wheels to be significantly greater in the axial direction than was theretofore possible while at the same time preventing the occurrence of any "back printing" or endorsing applications. It should be understood that the endorser drum may be provided with more than one insert strip groove and more than one group of resilient print wheels, if desired.

What is claimed is:

1. A rotatable endorser drum assembly for printing graphic information on paper documents passing between the drum assembly and a rotatably mounted platen means, said assembly comprising:

a cylindrical shaped drum, said drum having a continuous groove surrounding said drum and perpendicular to the axis of rotation of the drum;

the bottom of said groove having means for forming a curved convex contour;

a resilient elongated print strip mounted in said groove, said strip having a raised portion along one surface defining a print surface;

the opposite surface engaging said contour forming means whereby the convex contour urges the print surface to assume a curved convex contour substantially similar to the convex contour of the contour forming means;

said platen means having a groove at least as wide as the width of the print surface of said strip; said print surface extending only partially into the groove of said platen means whereby documents passing between said platen means and said print strip are engaged by said print surface;

and said print surface does not contact the platen means when no documents are passing therebetween to prevent the transfer of ink from said print surface to the platen thereby preventing the occurrence of back printing;

the convex surface of said print surface enabling the use of a print strip having a substantially large width measured in the axial direction of said drum.

2. The assembly of claim 1, wherein said contour forming means comprises forming the base of the drum groove to assume said convex contour.

3. The assembly of claim 1, wherein said contour forming means comprises a strip mounted in said drum groove beneath said print strip and having a substantially D-shaped cross-section.

4. The apparatus of claim 1 further comprising means releasably mounted on said drum for securing end portions of said print strip to said drum and thereby maintain said print strip in said drum groove.

5. The apparatus of claim 1 wherein the radius of curvature of said convex contour forming means is directly related to the width of the printing surface desired and is selected to control the width of the effective printing surface, without altering the width of the cooperating groove provided in said platen means.

6. The assembly of claim 1 wherein said groove is provided with a plurality of crowned portions arranged at axially spaced intervals along the recess;

said print strip having a width adapted to fill said recess and having raised print portions each positioned above the said crowned portions so as to be urged into a crowned contour.

7. A self-aligning indexable printing assembly comprising:

a rotatable drum;

a mounting pin secured near the periphery of said drum and having a substantially annular shaped surface, said surface having a substantially polygonal shaped periphery having a cross-sectional configuration comprised of a plurality of spaced outwardly extending, radially aligned projections, the free ends of said projections defining a crowned convex contour;

a print wheel rotatable on the pin and being formed of a resilient material and having a closed-loop configuration;

the exterior surface of said print wheel having a plurality of integrally formed raised characters and other indicia arranged at spaced intervals along said exterior surface and projecting outwardly therefrom to define a print surface;

the interior surface of said wheel having a configuration of alternating projections and grooves substantially complementary to the cross-sectional configuration of said pin and arranged in a preset manner relative to said spaced intervals, said wheel being mounted upon and surrounding the periphery of said pin so that the projections of said pin engage selected grooves in said print wheel and urge the print surface of said wheel into a similar convex crowned contour;

said wheel being adapted to fit upon said pin and, selectively experiencing only minimal stretching and deformation when the projections of said pin engage the said selected grooves of said print wheel;

the resilient characteristic of said print wheel permitting said print wheel to stretch and permitting the projections of said print wheel to compress when said print wheel is rotated about said pin to enable said print wheel projections to ride over the projections of said pin and to abruptly snap back to their uncompressed state when the projections of said print wheel have passed over the projections of said pin to thereby accurately incrementally align the characters on said print wheel as it is indexed about said pin and for preventing the print wheel from rotating about said pin when the pin revolves about the axis of the drum during printing, whereby the aforesaid arrangement eliminates the need for separate additional detent means.

8. The assembly of claim 7 further comprising;

rotatable platen means positioned to make rolling engagement with said drum and having a groove aligned with said printing assembly whereby documents passing between said drum and said platen means are engaged by a selected portion of the print surface of said print wheel;

said print surface being adapted to extend only partially into the groove in said platen means to prevent said printing surface from engaging the grooves in said platen means when no paper documents pass therebetween to prevent the transfer of ink from said print surface to said grooves thereby preventing backprinting;

said crowned contour enabling the width of the print wheel measured in the axial direction of said pin to be sufficient to print a plurality of characters aligned along said print surface in said axial direction.

9. An endorser drum assembly comprising:

a cylindrical shaped drum, said drum having a continuous groove surrounding said drum and perpendicular to the axis of rotation of the drum;

the base of said groove having means for forming a curved convex contour;

a resilient elongated print strip mounted in said groove, said strip having a raised portion along one surface defining a printing surface;

the opposite surface engaging said contour forming means to urge the print surface to assume a curved convex contour substantially similar to the convex contour of the base of said groove;

a self-aligning assembly mounted adjacent the periphery of said drum comprising a mounting pin secured to said drum near the surface thereof;

said mounting pin having a substantially annular shaped surface, said surface having a substantially polygonal shaped periphery having a cross-sectional configuration comprised of a plurality of spaced, outwardly extending, radially aligned projections, the free ends of said projections defining a crowned convex contour;

a print wheel rotatable on the pin and being formed of a resilient material and having a closed-loop configuration;

the exterior surface of said print wheel having a plurality of integrally formed raised characters and other indicia arranged at spaced intervals along said exterior surface and projecting outwardly therefrom;

the interior surface of said wheel having a configuration of alternating projections and grooves substantially complementary to the cross-sectional configuration to said pin, said wheel being mounted upon and surrounding the periphery of said pin so that the projections of said pin engage selected grooves in said print wheel and urge the print surface of said wheel into a similar convex crowned contour;

said wheel being adapted to fit upon said pin and selectively experiencing only minimal stretching and deformation when the projections of said pin engage the said selected grooves of said print wheel;

the resilient characteristic of said print wheel permitting said wheel to stretch and permitting the projections of said print wheel to compress when said print wheel is rotated about said pin to enable said print wheel projections to ride over the projections of said pin and to abruptly snap back to their uncompressed state when the projections of said print wheel have passed over the projections of said pin to thereby accurately incrementally index the characters on said print wheel about said pin and preventing the print wheel from rotating about said pin when printing, whereby the aforesaid arrangement eliminates the need for separate additional detent means.

10. An endorser assembly comprising:

a mounting frame including a pair of side plates and means for maintaining said plates in spaced parallel fashion;

each of said plates having elongated slots aligned with one another;

ink transfer roller means including first and second bearing means rotatably supporting an ink transfer roll and being slidably mounted within associated ones of said slots;

spring means for biasing said bearing means in a first direction;

said plates each having a pair of projections extending outwardly from one edge of the plate and defining an elongated open-ended slot therebetween;

rotatable endorser roll means having a pair of first and second bearings rotatably supporting an endorser roll and adapted to be slidably mounted in an associated one of said open-ended slots;

resilient means mounted to each plate for releasably securing said endorser bearings in said open-ended slots;

said spring means urging said ink transfer roll into engagement with said endorser roll;

an arm positioned between said plates and pivot means free-wheelingly mounting a first end of the arm to one of said plates;

inking roll means comprising an inking roll and means for rotatably supporting said inking roll at the opposite end of said arm;

an overcenter spring coupled at a first end to one of said plates and at a second end to said arm for selectively urging said inking roll into engagement with said ink transfer roll and for maintaining said inking roll displaced from said ink transfer roll when said arm is moved to respectively position the spring second end to the opposite sides of an imaginary linear center line extending between said overcenter spring first end, and the axis of the pivot at mounting of said arm.

11. The assembly of claim 8, wherein said endorser drum further comprises:

a cylindrical shaped drum, said drum having a cylindrical shaped groove surrounding said drum and perpendicular to the axis of rotation of the drum;

the base of said groove having means for forming a curved convex contour;

a resilent elongated print strip mounted in said groove, said strip having a raised portion along one surface defining a printing surface;

the opposite surface of the print strip engaging the base of said groove whereby the convex base urges the print surface to assume a curved convex contour substantially similar to the convex contour of the base of said groove.

12. The assembly of claim 10, wherein said endorser drum further comprises:

a mounting pin secured to said endorser drum near the periphery thereof;

said mounting pin having a substantially annular shaped surface, said surface having a substantially polygonal shaped periphery having a cross-sectional configuration comprised of a plurality of spaced, outwardly extending, radially aligned projections, the ree ends of said projections defining a crowned convex contour;

a print wheel rotatable on the pin and being formed of a resilient material and having a closed-loop configuration;

the exterior surface of said print wheel having a plurality of integrally formed raised characters and other indicia arranged at spaced intervals along said exterior surface and projecting outwardly therefrom;

the interior surface of said wheel having a configuration of alternating projections and grooves substantially complementary to the cross-sectional configuration of said pin, said wheel being mounted upon and surrounding the periphery of said pin so that the projections of said pin engage selected grooves in said print wheel and urge the print surface of said wheel into a similar convex crowned contour;

said wheel being adapted to fit upon said pin and selectively experiencing only minimal stretching and deformation when the projections of said pin engage the said selected grooves of said print wheel;

the resilient characteristic of said print wheel permitting said wheel to stretch and permitting the projections of said print wheel to compress when said print wheel is rotated about said pin to enable said print wheel projections to ride over the projections of said pin and to abruptly snap back to their uncompressed state when the projections of said print wheel have passed over the projections of said pin to thereby accurately incrementally index the characters on said print wheel about said pin and preventing the print wheel from rotating about said pin when printing, whereby the aforesaid arrangement eliminates the need for separate additional detent means.

13. Means for printing elongated lines of printed matter upon documents comprising a rotatable platen roll;

first and second rotatably mounted drums having their axes of rotation arranged at spaced parallel fashion;

a closed loop resilient elongated print strip being entrained about said first and second drums;

the surface of one of said first and second drums being positioned adjacent to the surface of said platen roll to urge said print strip against said platen roll;

means on said drum for directionally engaging said platen roll;

means for rotating said platen roll whereby the frictional engagement between said platen roll and said one drum imparts rotation to said first and second drums to linearly move said print strip;

said one drum and said platen roll forming a nip therebetween for advancing sheets entering into said nip;

said print strip having raised print portions;

means for transferring ink to said raised print portions to the confronting surface of the sheet being advanced through said nip, whereby said first and second drums eliminate the need for a single strip mounting print drum of large diameter;

said one drum being provided with a cylindrical shaped groove surrounding said drum the axis of said groove being coincident with the axis of rotation of the drum;

the base of said groove having means for forming a curved convex contour;

said resilient elongated print strip being positioned in said groove, said strip having a raised portion along one surface defining a printing surface;

the opposite surface engaging said contour forming means whereby the convex base urges the print surface to assume a curved convex contour substantially similar to the convex contour of said contour forming means;

said platen roll having a groove at least as wide as the width of said strip; said print surface extending only partially into the groove of said platen means whereby documents passing between said platen means and said print strip are engaged by said print surface.

14. The print means of claim 14 further comprising an additional plurality of rotatably mounted drums positioned in spaced relationship with said first and second drums and having their axes parallel to said first and second drums and to one another;

said print strip being entrained about all said first and second drums of said additional drums to whereby said additional drums are arranged to increase the path length of a strip of increased length without the need for increasing the separation distance between said first and second drums.

15. Means for printing elongated lines of printed matter upon documents comprising:

a rotatable platen roll;

first and second rotatably mounted drums having their axes of rotation arranged in spaced parallel fashion;

an elongated closed-loop resilient print strip being entrained about said first and second drums;

the surface of one of said first and second drums being positioned adjacent to the surface of said platen roll to urge said print strip toward said platen roll;

means on said one drum for frictionally engaging said platen roll;

means for rotating said platen roll whereby the frictional engagement between said platen roll and said one drum imparts rotation to said first and second drums and moves said print strip;

said one drum and said platen roll forming a nip therebetween for advancing sheets entering into said nip;

said print strip having raised print portions;

said platen roll having a groove at least as wide as the width of the raised portions of said print strips whereby said raised portions extend only partially into the groove of said platen roll so that documents passing between said platen roll and said raised portions are engaged by the surfaces of said raised portions and said print surface does not contact the platen means when no documents are passing therebetween to prevent the transfer of ink from said print surface to the platen roll, thereby preventing the occurrence of back-printing;

the print surface having a convex curvature enabling the use of a print strip having a substantially large width measured in the axial direction of said drums;

means for transferring ink to said raised print portions to thereby transfer the ink on said raised print portions to the confronting surface of the sheet being advanced through said nip, the circumferences of said first and second drums being less than the length of the print strip entrained about said drums;

said rotating means comprising motor means for rotating said plate roll;

means on said strip for marking the beginning of a line of printed matter, said marking means being displaced from the beginning of said line of printed matter;

gate means for restraining movement of a document;

means for sensing the passage of said marking means for opening said gate means to enable feeding of the restrained document.

16. The apparatus of claim 15, wherein said gate means is movable between a first position blocking the passage of documents through the printing location and a second position displaced from the blocking position;

second means for sensing the leading edge of a document approaching the first portion of said gate to move the gate to the second position.

17. The apparatus of claim 16 further comprising logic gate means for activating said motor when said gate is in the first position and said first sensing means has detected said marking means.

18. The apparatus of claim 17 further comprising means for applying the output of said first sensing means to said logic gate means after a predetermined delay.

* * * * *